United States Patent [19]

Lachaussee et al.

[11] 4,029,015

[45] June 14, 1977

[54] PRIMING CHAMBER FOR CARTRIDGES

[76] Inventors: Maurice Lachaussée, rue de l'Yser, 360, 4300 Ans, Belgium; André Maigret, 4, Avenue de la Grange, Saint-Maur-des-Fosses, France

[22] Filed: Dec. 24, 1975

[21] Appl. No.: 644,084

[30] Foreign Application Priority Data

July 8, 1975 Belgium ..... 45083

[52] U.S. Cl. ..... 102/45

[51] Int. Cl.[2] ..... F42C 19/10

[58] Field of Search ..... 102/45, 86.5

[56] References Cited

UNITED STATES PATENTS

| | | | |
|---|---|---|---|
| 2,021,498 | 11/1935 | Campbell | 102/45 |
| 2,868,128 | 1/1959 | Ramsey | 102/86.5 |
| 3,352,240 | 11/1967 | Eckstein | 102/45 |
| 3,777,664 | 12/1973 | Gawlick et al. | 102/45 |

FOREIGN PATENTS OR APPLICATIONS

| | | | |
|---|---|---|---|
| 557,100 | 4/1923 | France | 102/45 |
| 639,546 | 5/1962 | Italy | 102/45 |

*Primary Examiner*—Verlin R. Pendegrass
*Attorney, Agent, or Firm*—Young & Thompson

[57] ABSTRACT

A priming chamber for a cartridge comprising a cylindrical tubular body one end of which is closed by a bottom formed with vent holes arranged around an axially and inwardly extending pressed part forming an anvil, the anvil being of tapered shape having two integral parts of which the lower part is fixed to a flat portion of the bottom of the tubular body, whereas the upper part terminates in an upper outer flat end.

4 Claims, 3 Drawing Figures

PRIMING CHAMBER FOR CARTRIDGES

BACKGROUND OF THE INVENTION

The present invention relates to a priming chamber for a cartridge.

In order to fire the powder charge of a cartridge designed to release or launch a projectile, it is necessary to use a priming device commonly called a primer.

Primers are already known comprising three elements: a tubular body having a bottom with a vent hole therein, a dish or cap arranged to contain a detonator and a tubular or flat anvil.

Primers are also known comprising two elements usually called 6.45 or Jacobucci primers, i.e. a dish or cap containing the detonator and located in a cylindrical tubular body which is commonly called an envelope or chamber whose bottom is deformed by pressing to form a projecting conical anvil.

The primers of the latter type are advantageous in that they are constituted by two metallic parts only. However, they have the disadvantage that they are not high enough, and thus insufficient volume is provided in the envelope for the gas produced upon detonation, thereby limiting the power of the primers. Furthermore, the conical anvil which is low has a very large vertex angle, close to 90°, and a too rounded end on its outer face, and thus the distance between the firing pin and the rounded end of the anvil increases when the percussion occurs slightly off of the theoretical axis which results in percussion delays and sometimes also in misfires.

Moreover, the part forming the anvil, although held in position, is displaceable to a larger or lesser extent with respect to the chamber owing to a certain flexibility or elasticity, and thus the possibility still exists that the distance between the end or point of the anvil and the end of the firing pin may vary. Such a variation could result in a lack of sensitivity or in a defective percussion. Finally, vent holes or openings are difficult to be formed since they are located in the cone which constitutes the anvil.

An object of the invention is to eliminate the above mentioned drawbacks of the known two-piece primers.

BRIEF DESCRIPTION OF THE INVENTION

The priming chamber according to this invention is essentially a cylindrical tubular body one end of which is closed by a bottom formed with vent holes arranged around an axially and inwardly extending pressed part forming an anvil, characterized in that the anvil is of tapered shape having two integral parts of which a lower part is fixed to a flat portion of the bottom of the tubular body whereas an upper part terminates in an upper outer flat end.

Preferably the lower part of the anvil is conical and has reinforcement ribs or stiffeners extending at least along a diametrical axial plane of the envelope. As a further preferred feature of the invention, the lower part of the anvil has ribs or stiffeners extending along three axial diametrical planes arranged at 120° from each other, whereas as another preferred feature, the lower part is cylindrical.

The upper part may be conical or pyramidal at its end.

Near the reinforcement ribs or stiffeners, or around the cylindrical part of the anvil, the bottom has a flat portion which may have circular vent holes formed therein.

DETAILED DESCRIPTION OF THE INVENTION

The invention will now be described by way of example with reference to the accompanying drawing wherein.

Figure 1:
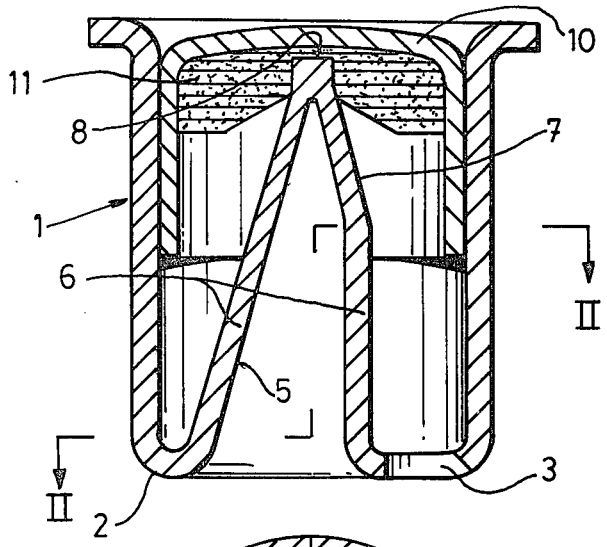
FIG. 1 is an axial diametrical cross-section view of a priming chamber.
Figure 2:
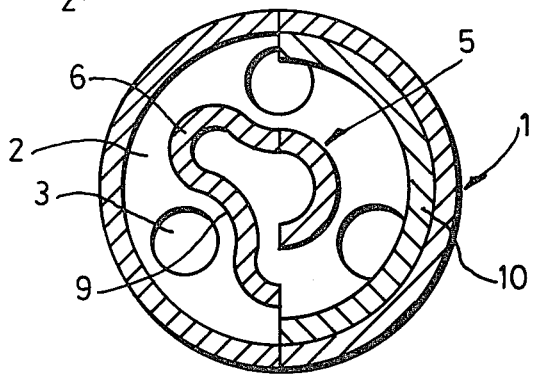
FIG. 2 is a cross-sectional view taken along line II-II of FIG. 1.
Figure 3:
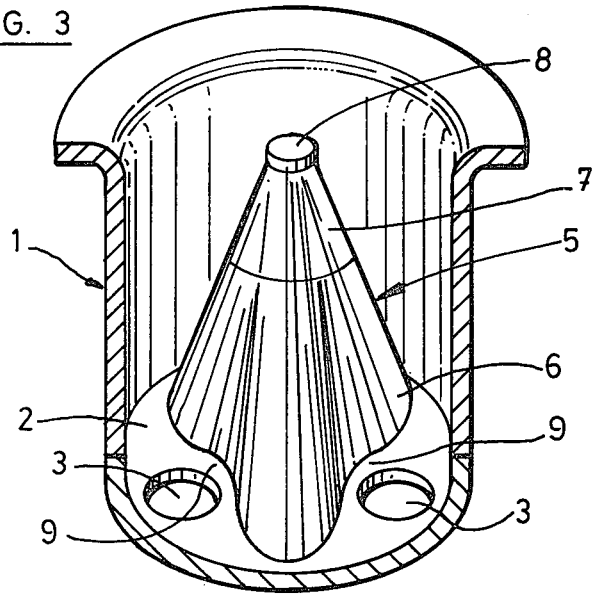
FIG. 3 is a diagrammatic partially perspective view of the priming chamber of FIG. 1.

With reference to the Figures, a two-part primer comprises a tubular cylindrical chamber or envelope 1 having a bottom 2 provided with circular vent holes 3 at its periphery. The chamber 1 is provided with a generally conical axially directed pressed part which forms an anvil 5 extending inwardly of the chamber 1 from and integral with the bottom 2. This anvil 5 has a lower generally conical part 6 connected to the bottom 2, and an upper tapered part 7 the upper and outer end 8 of which is flat. The part 7 is generally conical. The lower part 6 has grooves or radial stiffening ribs 9 extending along three diametrical planes at 120° from each other as is shown particularly in the left side of FIG. 2. The bottom of the ribs is substantially parallel to the longitudinal axis of the anvil 5 and the rib depth is then maximum near the bottom 2 of the chamber and decreases to become zero at the upper tapered part 7.

The vent holes 3 are formed in the flat portion of the bottom 2 near the ribs 9.

The chamber 1 is closed by a cap 10 containing a detonating material 11.

According to a possible modification, the conical lower part 6 is provided with only two diametrically opposed stiffening ribs. In other words, the part 6 is squashed or flattened along a diameter near the bottom 2.

According to further possible modifications, the upper part 7 may be of pyramidal shape and the lower part of the anvil 5 may be cylindrical.

Primers having a chamber such as that described above have various advantages among which the following should be mentioned. The anvil 5 is particularly stiff due to its stiffened conical shape and above all to its fixed positioning with respect to the tubular chamber or envelope which results in a fixed distance between the firing pin and the flat end of the end 8 of the anvil 5. Owing to the recesses in the anvil 5 and the height of the chamber, the volume available for the gas is comparatively large which ensures optimum priming power. Moreover, it is possible to form circular vent holes sufficiently large in size for the gas to flow therethrough but able to prevent powder pellets from escaping.

What is claimed is:

1. A priming chamber for a cartridge, comprising a cylindrical envelope having a flat bottom portion, an inwardly projecting anvil upstanding from said flat bottom portion, the flat bottom portion being formed with vent holes therein, said inwardly projecting anvil comprising a tapered lower portion integral with said flat bottom portion and a tapered upper portion having an upper outer flat end, said lower portion of the anvil having a plurality of ribs extending lengthwise of the anvil and spaced 120° from each other about said lower portion of the anvil.

2. A chamber as claimed in claim 1, in which said upper portion of the anvil is conical.

3. A chamber as claimed in claim 1, in which the bottoms of said ribs are parallel to the axis of said cylindrical envelope and the tops of said ribs converge in a direction away from said flat bottom portion.

4. A chamber as claimed in claim 3, the bottom of each said rib intersecting said flat bottom portion at a relatively wide portion of said flat bottom portion, there being a said vent hole in each said relatively wide portion of said flat bottom portion.

* * * * *